US010094007B2

(12) United States Patent
Wert et al.

(10) Patent No.: US 10,094,007 B2
(45) Date of Patent: Oct. 9, 2018

(54) METHOD OF MANUFACTURING A FERROUS ALLOY ARTICLE USING POWDER METALLURGY PROCESSING

(71) Applicant: CRS Holdings Inc., Wilmington, DE (US)

(72) Inventors: David E. Wert, Wyomissing, PA (US); Timothy R. Armstrong, Clinton, TN (US); David A. Helmick, Wyomissing, PA (US); Michael L. Schmidt, Sinking Spring, PA (US)

(73) Assignee: CRS Holdings Inc., Wilmington, DE (US)

( * ) Notice: Subject to any disclaimer, the term of this patent is extended or adjusted under 35 U.S.C. 154(b) by 0 days.

(21) Appl. No.: 14/282,762

(22) Filed: May 20, 2014

(65) Prior Publication Data

US 2015/0118095 A1 Apr. 30, 2015

Related U.S. Application Data

(63) Continuation-in-part of application No. 14/061,845, filed on Oct. 24, 2013, now abandoned.

(51) Int. Cl.

| | |
|---|---|
| ***C22C 33/02*** | (2006.01) |
| ***C22C 33/04*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 1/18*** | (2006.01) |
| ***C21D 6/00*** | (2006.01) |
| ***C21D 8/00*** | (2006.01) |
| ***B22F 3/15*** | (2006.01) |
| ***C22C 38/06*** | (2006.01) |
| ***C22C 38/00*** | (2006.01) |
| *B22F 3/17* | (2006.01) |
| *C21D 6/04* | (2006.01) |
| *C21D 7/13* | (2006.01) |

(52) U.S. Cl.

CPC ..... *C22C 33/0285* (2013.01); *B22F 3/15* (2013.01); *C21D 1/18* (2013.01); *C21D 6/004* (2013.01); *C21D 8/005* (2013.01); *C22C 33/04* (2013.01); *C22C 38/001* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *B22F 3/17* (2013.01); *B22F 2998/10* (2013.01); *C21D 6/04* (2013.01); *C21D 7/13* (2013.01); *C21D 2211/004* (2013.01); *C21D 2211/008* (2013.01)

(58) Field of Classification Search

CPC ..... C22C 33/0285; C22C 33/04; C22C 38/02; C22C 38/04; C22C 38/42; C22C 38/44; C22C 38/46; C22C 38/48; C22C 38/50; C22C 38/52; C21D 1/18; C21D 6/004; C21D 8/005; B22F 3/15

USPC ..... 420/36, 38, 39

See application file for complete search history.

(56) References Cited

U.S. PATENT DOCUMENTS

| | | | | |
|---|---|---|---|---|
| 4,609,526 | A * | 9/1986 | Haswell et al. | 419/23 |
| 5,650,024 | A | 7/1997 | Hasegawa et al. | |
| 5,900,560 | A | 5/1999 | Pinnow et al. | |
| 6,030,469 | A | 2/2000 | Ernst et al. | |
| 6,117,388 | A | 9/2000 | Shibata et al. | |
| 6,187,261 | B1 | 2/2001 | Fedchun | |
| 6,210,633 | B1 * | 4/2001 | Kratt et al. | 419/49 |
| 6,238,455 | B1 | 5/2001 | Brown et al. | |
| 6,426,038 | B1 | 7/2002 | Fedchun | |
| 6,426,040 | B1 | 7/2002 | Fedchun | |
| 6,482,354 | B1 * | 11/2002 | Wert et al. | 420/10 |
| 6,630,103 | B2 | 10/2003 | Martin et al. | |
| 7,067,019 | B1 | 6/2006 | Fedchun et al. | |
| 7,160,399 | B2 | 1/2007 | Kuehmann et al. | |
| 8,071,017 | B2 | 12/2011 | Fedchun et al. | |
| 8,361,247 | B2 | 1/2013 | Vartanov | |
| 2003/0049153 | A1 | 3/2003 | Martin et al. | |
| 2004/0211293 | A1 | 10/2004 | Shamblen et al. | |
| 2009/0196784 | A1 | 8/2009 | Fedchun et al. | |
| 2010/0206129 | A1 | 8/2010 | Bergman et al. | |

(Continued)

FOREIGN PATENT DOCUMENTS

| | | |
|---|---|---|
| EP | 0411931 | 2/1991 |
| EP | 0648854 A1 | 4/1995 |
| EP | 0867522 | 9/1998 |
| EP | 0867523 | 9/1998 |
| EP | 1466993 | 10/2004 |
| GB | 796733 | 6/1958 |
| GB | 1250898 | 10/1971 |
| GB | 2288188 | 10/1995 |

(Continued)

OTHER PUBLICATIONS

Lee, E.U., et al., "Aircraft Steels", Unclassified Report No. NAWCADPAX/TR-2009/12, dated Feb. 19, 2009, 46 pages.

(Continued)

*Primary Examiner* — Helene Klemanski
(74) *Attorney, Agent, or Firm* — Barley Snyder

(57) ABSTRACT

A method of manufacturing a ferrous alloy article is disclosed and includes the steps of melting a ferrous alloy composition into a liquid, atomizing and solidifying of the liquid into powder particles, outgassing to remove oxygen from the surface of the powder particles, and consolidating the powder particles into a monolithic article.

27 Claims, No Drawings

(56) References Cited

U.S. PATENT DOCUMENTS

2011/0094637 A1 4/2011 Wright et al.

FOREIGN PATENT DOCUMENTS

WO WO 2010044740 A1 * 4/2010
WO 2014066570 A1 5/2014

OTHER PUBLICATIONS

Technical Datasheet, Ferrium S53 Corrosion Resistant Ultrahigh-Strength Steel for Aerospace Structural Applications, QuesTek Innovations LLC, dated Mar. 2010, 2 pages.
International Search Report, PCT/US2013/066496, dated Feb. 5, 2014, 5 pages.
Written Opinion of ISA, PCT/US2013/066496, dated Feb. 5, 2014, 9 pages.
Carnes, Robert E. and Wert, David E., "New Powder Metal Alloy Bridges Gap Between High Speed Steel and Tungsten Carbide", Carpenter Technology Articles, dated May 2001, 5 pages.
Toro A., Alonso-Fallerios N., Rodrigues D., Filho Ambrozio F., Liberati J.F., Tschiptschin A.P., "PIM Processing of Nitrogen Bearing Corrosion Resistant Martensitic Stainless Steels", Trans. Indian Inst. Met., vol. 55, No. 5, dated Oct. 2002, pp. 481-487.
Samal Prasan K., Valko Joshua C. and Pannell Joseph D., "Processing and Properties of PM 440C Stainless Steel", presented at PowderMet2009, Las Vegas, USA, Jun. 29, 2009, 10 pages.
Bampton Cliff, Goodin Wes, Van Daam Tom, Creeger Gordon and James Steve, "Net-Shape HIP Powder Metallurgy Components for Rocket Engines", 31 pages.
Extended European Search Report, Application No. 15168458, dated Jan. 29, 2016, 7 pages.
Chinese Notification of the First Office Action and English translation, dated Mar. 26, 2018, 12 pages.

* cited by examiner

METHOD OF MANUFACTURING A FERROUS ALLOY ARTICLE USING POWDER METALLURGY PROCESSING

CROSS REFERENCE TO RELATED APPLICATION

This application is a Continuation-In-Part which claims the benefit of U.S. patent application Ser. No. 14/061,845, filed Oct. 24, 2013.

FIELD OF THE INVENTION

This invention relates generally to a method of manufacturing a ferrous alloy and, in particular, to a method of manufacturing a high toughness martensitic ferrous alloy using powder metallurgy processing.

BACKGROUND

Aircraft landing gear are critical components that are highly stressed and subject to adverse environmental conditions in use. Steel alloys such as AISI 4340 and the 300M alloy have long been used to make landing gear for aircraft because those alloys can be quenched and tempered to provide very high strength (ultimate tensile strength of at least 280 ksi) in combination with fracture toughness ($K_{Ic}$) of at least 50 ksi√in. However, neither of those alloys provides effective corrosion resistance. Therefore, it has been necessary to plate the landing gear components with a corrosion resistant metal such as cadmium. Cadmium is a highly toxic, carcinogenic material and its use has presented significant environmental risks in the manufacture and maintenance of aircraft landing gear and other components made from these alloys.

A known alloy that is sold under the registered trademark FERRIUM S53 was developed to provide a combination of strength and toughness similar to that provided by the 4340 and 300M alloys and to also provide corrosion resistance. The FERRIUM S53 alloy was designed to overcome the problems associated with using cadmium plating to provide adequate corrosion resistance in aircraft landing gear made from either the 4340 alloy or the 300M alloy. However, the FERRIUM S53 alloy includes a significant addition of cobalt which is a rare and thus, expensive element. In order to avoid the much higher cost of using the FERRIUM S53 for the landing gear application, attempts have been made to develop a quench and temper steel alloy that provides the strength, toughness, and corrosion resistance attributed to the FERRIUM S53 alloy, but without the addition of costly cobalt.

Cobalt-free martensitic steel alloys that can be quenched and tempered to provide strength and toughness comparable to the FERRIUM S53 alloy and which also provide corrosion resistance are described in U.S. Pat. No. 8,071,017 and in U.S. Pat. No. 8,361,247. However, it has been found that the corrosion resistance provided by those steels leaves something to be desired. Enhanced corrosion resistance is especially important for aircraft landing gear because they are exposed to many different types of corrosive environments, some of which are more aggressive than others at causing corrosion in steel. Accordingly, there is a need for a steel alloy that provides the very high strength and toughness needed for the landing gear application, that provides better corrosion resistance than the known corrosion resistant quench and temper steels, and that can be produced at a discount in price relative to steels that contain a substantial amount of cobalt.

Furthermore, known martensitic steel alloys are generally melted via conventional means, including vacuum induction melt (VIM), and VIM/vacuum arc remelting (VAR). The known alloy is then cast into ingot form, and processed either through rolling or forging to obtain the final desired product, either billet or bar. However, there is a desire in the aerospace industry for near net shape processing, so that parts can be manufactured with much less machining and less waste of material compared to conventional processing such as machining from bar or rough forged billet.

SUMMARY

In view of the aforementioned shortcomings, among others, a method of manufacturing a ferrous alloy article is disclosed. The ferrous alloy article is provided by melting a ferrous alloy composition into a liquid, atomizing and solidifying of the liquid into powder particles, outgassing to remove oxygen from the surface of the powder particles, and consolidating the powder particles into a monolithic article.

DETAILED DESCRIPTION OF THE EMBODIMENT(S)

The invention is a ferrous alloy having improved desirable material properties, such as wear resistance, corrosion resistance, strength, and toughness.

The ferrous alloy according to the invention includes a base composition of carbon (C), manganese (Mn), silicon (Si), chromium (Cr), nickel (Ni), molybdenum (Mo), copper (Cu), cobalt (Co), vanadium (V), and iron (Fe). However, it is also possible that the base composition includes tungsten (W), vanadium (V), titanium (Ti), niobium (Nb), tantalum (Ta), aluminum (Al), nitrogen (N), cerium (Ce), and lanthanum (La).

In particular, in an exemplary embodiment of the invention, the ferrous alloy includes a nominal composition having a proportion of 0.2-0.5 wt. % of C, 0.1-1.0 wt. % of Mn, 0.1-1.2 wt. % of Si, 9-14.5 wt. % of Cr, 3.0-5.5 wt. % of Ni, 1-2 wt. % of Mo, 0-1.0 wt. % of Cu, 1-4 wt. % of Co, 0.2 max. wt. % of W, 0.1-1.0 wt. % of V, up to 0.5 wt. % of Ti, 0-0.5 wt. % of Nb, 0-0.5 wt. % of Ta, 0-0.25 wt. % of Al, 0.05 max. wt. % of N, 0-0.01 wt. % of Ce, 0-0.01 wt. % of La, and a balance wt % of Fe to complete the composition.

As shown in Table 1, the ferrous alloy may have the following wt. % of compositions.

TABLE 1

Exemplary Steel Alloy Compositions

| | Range 1 | Range 2 |
|---|---|---|
| C | 0.2-0.5 | 0.35-0.45 |
| Mn | 0.1-1.0 | 0.1-0.7 |
| Si | 0.1-1.2 | 0.1-1.0 |
| Cr | 9-14.5 | 9.5-12.5 |
| Ni | 3.0-5.5 | 3.2-4.3 |
| Mo | 1-2 | 1.25-1.75 |
| Cu | 0-1.0 | 0.1-0.7 |
| Co | 1-4 | 2-3 |
| W | 0.2 max. | 0.1 max. |
| V | 0.1-1.0 | 0.3-0.6 |
| Ti | 0.5 max | 0.2 max |
| Nb | 0.5 max | 0.01 max. |
| Ta | 0.5 max | 0.01 max. |
| Al | 0.25 max | 0.01 max. |

TABLE 1-continued

| Exemplary Steel Alloy Compositions | | |
|---|---|---|
| | Range 1 | Range 2 |
| N | 0.05 max. | 0.03 max. |
| Ce | 0.01 max | 0.006 max |
| La | 0.01 max | 0.005 max |

As discussed, the balance of the ferrous alloy is Fe. In another exemplary embodiment of the invention, the ferrous alloy may include a composition having other elements and impurities commonly known to one skilled in the art, including not more than about 0.01% phosphorus and not more than about 0.002% sulfur The foregoing tabulation is provided as a convenient summary and is not intended to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of range 1 can be used with the minimum or maximum for the same element in range 2, and vice versa. Moreover, the ferrous alloy according to the present invention may comprise, consist essentially of, or consist of the constituent elements described above and throughout this application. Here and throughout this specification the term "percent" or the symbol "%" means percent by weight or mass percent, unless otherwise specified.

In accordance with another aspect of the present invention, there is provided a quenched and tempered steel article that is made from either of the ferrous alloy compositions set forth above. The steel article is characterized by having a tensile strength of at least about 280 ksi and a fracture toughness ($K_{Ic}$) of at least about 65 ksi√in. The steel article is further characterized by having good resistance to general corrosion as determined by the salt spray test (ASTM B117) and good resistance to pitting corrosion as determined by the cyclic potentiodynamic polarization method (ASTM G61 Modified).

At least about 0.2% and in another embodiment at least about 0.35% C is present in the ferrous alloy. Carbon combines with iron to form an Fe—C martensitic structure that facilitates the high hardness and strength provided by the ferrous alloy. Carbon also forms carbides with Mo, V, Ti, Nb, and/or Ta that further strengthen the ferrous alloy during tempering. The carbides that form in the present alloy are predominantly MC-type carbides, but some $M_2C$, $M_6C$, $M_7C_3$, and $M_{23}C_6$ carbides may also be present. Too much carbon adversely affects the toughness and ductility provided by the ferrous alloy. Therefore, carbon is restricted to not more than about 0.5% and in another embodiment to not more than about 0.45%.

The ferrous alloy according to this invention contains at least about 9% Cr to benefit the corrosion resistance and hardenability of the ferrous alloy. The ferrous alloy may contain at least about 9.5% chromium. In another embodiment, the ferrous alloy may not contain more than about 12.5% Cr. In another exemplary embodiment, the ferrous alloy may not contain more than about 14.5% Cr, as higher percentages of Cr may adversely affect the toughness and ductility provided by the ferrous alloy.

Ni is beneficial to the toughness and ductility provided by the ferrous alloy according to this invention. Therefore, the ferrous alloy contains at least about 3.0% Ni, and in another embodiment at least about 3.2% Ni. The amount of Ni may be restricted to not more than about 5.5%. In another embodiment, the amount of Ni may be restricted to not more than about 4.3%.

Mo is a carbide forming element that forms $M_6C$ and $M_{23}C_6$ carbides for temper resistance in the ferrous alloy. Mo also contributes to the strength and fracture toughness provided by the ferrous alloy. Furthermore, Mo contributes to the pitting corrosion resistance provided by the ferrous alloy. The benefits provided by Mo are realized when the ferrous alloy contains at least about 1% Mo. In another embodiment, the ferrous alloy may contain at least about 1.25% Mo. In another embodiment the ferrous alloy may not contain more than about 1.75% Mo. In yet another embodiment, the ferrous alloy may contain not more than about 2% Mo.

The ferrous alloy of this invention contains a small positive addition of Co to benefit the strength and toughness provided by the ferrous alloy. Co may be beneficial for the corrosion resistance for the ferrous alloy. For these reasons, the ferrous alloy contains at least about 1% Co. In another embodiment, the ferrous alloy may contain at least about 2% Co. Since Co is a rare element, Co is very expensive. In order to obtain the benefits of Co in the ferrous alloy and yet maintain a reduced cost, the ferrous alloy may not contain 6% or more of Co. In another embodiment, the ferrous alloy may contain not more than about 4% Co. In yet another embodiment, the ferrous alloy may contain not more than about 3% Co.

V and Ti combine with some of the C to form MC-type carbides that limit the grain size which in turn benefits the strength and toughness provided by the ferrous alloy according to this invention. Therefore, the ferrous alloy contains at least about 0.3% V. In another embodiment, the ferrous alloy contains at least about 0.1% V. In yet another embodiment, the ferrous alloy may contain no Ti or only up to about 0.01% Ti. Too much V and/or Ti adversely affects the strength of the ferrous alloy because of the formation of larger amounts of carbides in the ferrous alloy that depletes carbon from the martensitic matrix material. Accordingly, in an exemplary embodiment, V may be restricted to not more than about 0.6% and Ti is restricted to not more than about 0.2% in the ferrous alloy.

At least about 0.1%, Mn may be present in the ferrous alloy primarily to deoxidize the ferrous alloy. It is believed that Mn may also benefit the high strength provided by the ferrous alloy. If too much Mn is present, then an undesirable amount of retained austenite may remain after quenching such that the high strength provided by the ferrous alloy is adversely affected. In an embodiment of the invention, the ferrous alloy contains not more than about 1.0% Mn. In another embodiment, the ferrous alloy contains not more than about 0.7% Mn.

Si benefits the hardenability and temper resistance of the ferrous alloy. Therefore, the ferrous alloy contains at least about 0.1% silicon. Too much silicon adversely affects the hardness, strength, and ductility of the ferrous alloy. In order to avoid such adverse effects Si is restricted to not more than about 1.2%. In another embodiment, the ferrous alloy contains not more than about 1.0% Si.

Cu may be present in the ferrous alloy because it contributes to the hardenability, toughness, and ductility of the ferrous alloy. Cu may also benefit the ferrous alloy's corrosion resistance. The ferrous alloy may contain at least about 0.1% and better yet at least about 0.3% copper. Cu and Ni should be balanced in the ferrous alloy, particularly when the ferrous alloy contains very low or no positive addition of Cu. Thus, when the ferrous alloy contains less than 0.1% Cu, for example, not more than about 0.01% Cu, at least about 3.75% Ni, and not more than about 4.0% Ni should be present to ensure that the desired combination of strength, toughness, and ductility are provided. In one embodiment, Cu may be not more than about 1.0%. In another embodiment, the ferrous alloy may contain not more than about 0.7%. Cu W is a carbide forming element which, like Mo, contributes to the hardness and strength of the ferrous alloy when present. A small amount of W, up to about 0.2% may be present in the ferrous alloy or may be used in substitution of the Mo. In an exemplary embodiment, the ferrous alloy may contain not more than about 0.1% W.

Nb and Ta are carbide forming elements that combine with C to form carbides to benefit grain size control in the ferrous alloy. Therefore, the ferrous alloy may contain Nb and/or Ta provided that the combined amount of Nb and Ta (Nb+Ta) is not more than about 0.5%. However, in order to avoid the formation of excessive amounts of carbides, the ferrous alloy may contain not more than about 0.01% of Nb and/or Ta.

In an embodiment of the invention, up to about 0.25% Al may be present in the ferrous alloy from deoxidation additions during melting. In another embodiment, the ferrous alloy may contain not more than about 0.01% Al.

Up to about 0.01% of Ce and/or La may be present in the ferrous alloy as a result of misch metal additions during primary melting. The misch metal addition benefits the toughness of the ferrous alloy by combining with S and or oxygen (O) in the ferrous alloy, thereby limiting the size and shape of sulfide- and oxysulfide-inclusions that may be present. In another embodiment, the ferrous alloy does not contain more than about 0.006% Ce and, in another embodiment, the ferrous alloy does not contain more than about 0.005% La from such additions.

As discussed, the balance of the ferrous alloy is Fe and the usual impurities found in known grades of steels intended for similar purpose or service. In this regard, phosphorus (P) is restricted to not more than about 0.01%. In another embodiment, the ferrous alloy contains not more than about 0.005% P in the ferrous alloy. Also, S is restricted to not more than about 0.002% in the ferrous alloy. In another embodiment, the ferrous alloy contains not more than about 0.0005%. S.

Now, a method of manufacturing a ferrous alloy article according to the invention will be discussed. Firstly, the ferrous alloy article may be prepared from the composition discussed above, or from other high toughness martensitic compositions according to the invention.

The ferrous alloy article may be typically prepared using known vacuum induction melting (VIM) and refined by vacuum arc remelting (VAR) processing techniques. However, since there is a desire in the aerospace industry for near net shape processing, the ferrous alloy article according to the invention may be manufactured using powder metallurgy processing.

In general, the method of manufacturing the ferrous alloy article using powder metallurgy processing according to the invention includes melting a composition in to a liquid, atomizing the liquid into a metal powder, and then compacting the metal powder into a ferrous alloy article. Furthermore, the composition may be further refined using subsequent manufacturing processes before forming the ferrous alloy article.

Firstly, a blend is selected that is consistent with the ferrous alloy composition described above. The blend is then processed into a liquid, for instance, using an induction furnace. The liquid may then be refined and possibly degassed, if necessary. The liquid is dispersed through a nozzle where the liquid is atomized using a high pressure inert gas, such as Argon or Nitrogen. The liquid is accordingly atomized into powder particles. The fine powder particles are then separated from the atomization inert gas using a cyclone, while the coarse powder particles fall through the gas and are collected in a collection chamber. Both coarse and fine powder particles are then screened using a mesh to collect like sizes of particles, which then may be blended together to homogenize the powder particles.

Since gases may be adsorbed onto the surface of the powder particles, outgassing may be performed to lower the gas content on the powder particle surface. For instance, it may be desirable lower the oxygen content. Accordingly, the powder particles may be placed in a vessel and subject to vacuum hot outgassing to remove oxides, which can create boundary problems that reduce ductility and toughness. The outgassing uses inherent C in the powder particles to remove the oxides. Therefore, it may be possible to reduce the oxygen content to approximately ≤20 ppm, or possibly ≤10 ppm.

Next, the powder particles are further processed using a consolidation technique, such as hot isostatic pressing (HIP).

In an exemplary embodiment, the powder particles may be consolidated using HIP, wherein a container is filled with the powder particles and then manufactured using HIP to eliminate internal microporosity and enable densification of powder particles into a solid state. Heat and pressure are applied to powder particles to a temperature of 2050° F. and a pressure of 15 ksi, and a dense monolithic ferrous alloy article is provided. The dense monolithic ferrous alloy article can either be used as is or be further processed, such as by forging or other conventional hot working methods to shape or form the dense monolithic ferrous alloy article into a useable component.

In another embodiment, the powder particles may be consolidated using a rapid forging processing. For instance, a medium is positioned around a can of powder particles to evenly distribute a load from a press that consolidates the powder particles.

One skilled in the art should appreciate that other known consolidation techniques may be used, including an extrusion process.

The ferrous alloy article described above may be processed in accordance with the foregoing processing steps to provide a combination of properties that make it particularly useful for aerospace structural components, including but not limited to landing gear components, structural components, flap tracks and slat tracks, fittings and for other applications.

The terms and expressions which are employed in this specification are used as terms of description and not of limitation. There is no intention in the use of such terms and expressions of excluding any equivalents of the features shown and described or portions thereof. It is recognized that various modifications are possible within the invention described and claimed herein.

What is claimed is:

1. A method of manufacturing a ferrous alloy article, comprising the steps of:

melting a ferrous alloy composition into a liquid, the ferrous alloy composition including, in wt. % of about C 0.2-0.45; and of Co at least about 1 up to 6;

atomizing and solidifying the liquid into powder particles;

removing oxygen from surfaces of the powder particles through vacuum hot outgassing to remove oxides and reducing a bulk oxygen content to approximately ≤20 ppm; and consolidating the powder particles into a monolithic article.

2. The method of claim 1, wherein the step of consolidating the powder particles is performed using hot isostatic pressing (HIP).

3. The method of claim 2, wherein removal of oxygen from the surface performed through outgassing is performed on the powder particles positioned in a container.

4. The method of claim 1, wherein atomization is performed using a high pressure inert gas.

5. The method of claim 4, wherein the high pressure inert gas is Nitrogen.

6. The method of claim 4, wherein the high pressure inert gas is Argon.

7. The method of claim 1, wherein the monolithic article is consolidated from the powder particles in a container.

8. The method of claim 1, further comprising the step of separating the powder particles by size.

9. The method of claim 8, wherein the separated powder particles are mixed into a homogenized blend.

10. The method of claim 1, further comprising the step of screening the powder particles using a mesh.

11. The method of claim 10, wherein the separated powder particles are mixed into a homogenized blend.

12. The method of claim 11, wherein outgassing reduces a bulk oxygen content of a resulting consolidated product to approximately ≤10 ppm.

13. The method of claim 1, further comprising the step of filing a container with the powder particles.

14. The method of claim 1, further comprising the step of forging the monolithic article.

15. The method of claim 1, further comprising the step of hot working the monolithic article.

16. The method of claim 1, wherein the ferrous alloy composition includes, in wt. % of, about:

| | |
|---|---|
| Mn | 0.1-1.0 |
| Si | 0.1-1.2 |
| Cr | 9-14.5 |
| Ni | 3.0-5.5 |
| Mo | 1-2 |
| Cu | up to 1.0 |
| V | 0.1-1.0 |
| Ti | up to 0.5 |

the balance of the ferrous alloy being iron and usual impurities including not more than about 0.01% phosphorus and not more than about 0.002% sulfur.

17. The method of claim 16, wherein the ferrous alloy composition includes, in wt. % of, about:

| | |
|---|---|
| C | 0.35-0.45 |
| Mn | 0.1-0.7 |
| Si | 0.1-1.0 |

-continued

| | |
|---|---|
| Cr | 9.5-12.5 |
| Ni | 3.2-4.3 |
| Mo | 1.25-1.75 |
| Cu | 0.1-1.0 |
| Co | 2-3 |
| V | 0.3-0.6 |
| Ti | up to 0.2 |

the balance being iron and the usual impurities including not more than about 0.005% phosphorus and not more than about 0.0005% sulfur.

18. A method of manufacturing a ferrous alloy article, comprising the steps of:

melting a ferrous alloy composition into a liquid, the ferrous alloy composition including, in wt. % of about C 0.2-0.45; and of Co at least about 1 up to 6;

atomizing and solidifying the liquid into powder particles;

separating the powder particles by size;

mixing the powder particles into a homogenized blend;

removing oxygen from surfaces of the powder particles through vacuum hot outgassing to remove oxides and reducing a bulk oxygen content to approximately ≤20 ppm; and consolidating the powder particles into a monolithic article.

19. The method of claim 18, wherein a high pressure inert gas selected from the group consisting of nitrogen and argon is used in atomizing the liquid.

20. The method of claim 19, wherein outgassing reduces a bulk oxygen content of a resulting consolidated product to approximately ≤10 ppm.

21. The method of claim 20, further comprising the step of filing a container with the powder particles.

22. The method of claim 21, further comprising the step of forging the monolithic article.

23. The method of claim 22, further comprising the step of hot working the monolithic article.

24. A method of manufacturing a ferrous alloy article, comprising the steps of:

melting a ferrous alloy composition into a liquid, the ferrous alloy composition including, in wt. % of about C 0.2-0.45; and of Co at least about 1 up to 6;

atomizing and solidifying the liquid into powder particles using a high pressure inert gas selected from the group consisting of nitrogen and argon;

separating the powder particles by size;

mixing the separated powder particles into a homogenized blend;

vacuum hot outgassing to remove oxides from surfaces of the powder particles positioned in a container to reduce a bulk oxygen content to approximately ≤20 ppm; and consolidating the powder particles into a monolithic article using hot isostatic pressing (HIP).

25. The method of claim 24, wherein outgassing reduces a bulk oxygen content of a resulting consolidated product to approximately ≤10 ppm.

26. The method of claim 24, further comprising the step of forging the monolithic article.

27. The method of claim 26, further comprising the step of hot working the monolithic article.

* * * * *